United States Patent [19]

Imada et al.

[11] Patent Number: 4,622,886

[45] **Date of Patent: * Nov. 18, 1986**

[54] HYDRAULIC CONTROL CIRCUIT SYSTEM

[76] Inventors: Yusuke Imada; Isamu Hiroe; Tomoyuki Higuchi; Seiichi Kato; Masahiro Tanino, all of c/o Sanyo Kiki Kabushiki Kaisha, No. 14-1, all of Ikejiri Aza Ishinoki, Itami-shi, Hyogo-ken, Japan

[ * ] Notice: The portion of the term of this patent subsequent to Oct. 18, 2000 has been disclaimed.

[21] Appl. No.: 182,073

[22] Filed: Aug. 28, 1980

[51] Int. Cl.[3] ..... F15B 11/16

[52] U.S. Cl. ..... 91/520; 91/437; 91/530

[58] Field of Search ..... 91/520, 529, 531, 517, 91/530, 437, 440

[56] References Cited

U.S. PATENT DOCUMENTS

| | | | |
|---|---|---|---|
| 3,407,947 | 10/1968 | Valla | 91/520 |
| 3,543,645 | 12/1970 | Baatrup | 91/520 |
| 3,555,968 | 1/1971 | Praddaude | 91/520 |
| 4,266,749 | 5/1981 | Lundström | 91/520 |
| 4,268,228 | 5/1981 | McKee | 91/517 |
| 4,343,151 | 8/1982 | Lorimor | 91/520 |

FOREIGN PATENT DOCUMENTS

| | | | |
|---|---|---|---|
| 74377 | 12/1944 | Czechoslovakia | 91/520 |
| 1176987 | 5/1957 | France | 91/520 |

*Primary Examiner*—Abraham Hershkovitz

[57] ABSTRACT

A hydraulic control circuit system comprises first and second double-acting cylinders, a hydraulic pump for supplying the double-acting cylinders with pressure oil, and directional control valves respectively associated with the cylinders for controlling the supply of pressure oil to the latter. The hydraulic control circuit system has a circuit for independently operating the individual cylinders and also a circuit for causing the rod advancing and retracting actions of the first cylinder to be followed by the rod advancing and retracting actions of the second cylinder. The system is applied to the hydraulic control circuit of, e.g., a front loader for controlling a hydraulic cylinder used for lifting and lowering the loader arm and another hydraulic cylinder used for turning the bucket pivotally connected to the free end of the arm. In that case, the system ensures that the upward and downward movements of the arm are followed by the turning of the bucket so as to prevent the load in the bucket from spilling, which would be otherwise caused by the tilting of the bucket with respect to the horizontal.

3 Claims, 19 Drawing Figures

4
5
5a
5b
4a
4b
B
SCOOP
j
k
l
dump
h
i
g
203
13
10
12
14
11
A
LIFT
d
e
f
LOWER
b
c
a
202
9
7
8
6

LIFT
LOWER
SCOOP
DUMP
1
2
3
4
5
200

HYDRAULIC CONTROL CIRCUIT SYSTEM

BACKGROUND OF THE INVENTION

The present invention relates to a hydraulic control circuit system for controlling two double-acting hydraulic cylinders individually or collectively at the same time.

The invention can be applied to a front loader or the like to control a hydraulic cylinder associated with the loader arm to lift and lower the latter and a second hydraulic cylinder used for turning a working implement, such as a bucket, pivotally connected to the free end of said arm. Therefore, the invention will be described by way of example as applied to a front loader but, of course, it is not limited thereto.

A loader, such as a front loader, has a bucket, fork, blade or other attachment pivotally connected to the free end of its arm which is swingable in a vertical plane, and includes individual hydraulic cylinders for operating said arm and said attachment. Conventionally, these hydraulic cylinders have been individually or independently operated by multi-position directional control valves. Therefore, if the arm alone were lifted or lowered with the bucket filled with the load, the bucket would tilt with respect to the horizontal and the load would spill. It is necessary, therefore, to turn also the bucket in operative association with the upward and downward movements of the arm so as to maintain the bucket horizontal. However, the conventional manner of individually manipulating the respective operating levers of the two directional control valves so as to effect satisfactory operation of the two cylinders is inefficient and liable to cause mistakes in operation. Additionally, it is often necessary to maneuver the tractor at the same time. Thus, a number of operations must be performed at the same time. Therefore, such inefficient manner of operation greately lowers the efficiency of operation.

The dump action of the bucket should advantageously be as rapid as possible in order to provide increased efficiency of operation and improved release from the bucket of its relatively adhesive contents, such as earth and sand, livestock feedstuffs, and snow. To this end, various proposals have been made, including one for increasing the size of hydraulic pumps and pipings, one for using a vacuum prevention valve to rapidly project the rod under the weight of the load and its own weight, and one for arranging a directional control valve in the form of a differential circuit. These proposals, however, have disadvantages in cost, operation and back pressure rise due to pipings and valves and have not been satisfactory. On the other hand, in the case of relatively easily crushable farm products, such as beets, potatoes and cabbages, it is desirable to discharge them relatively slowly so as to avoid damage thereto. Therefore, it is desirable that any suitable value for the rotative speed of the attachment, namely, for the rod advancing or projecting speed of the dump cylinder associated therewith be selectable in accordance with the type of the object to be handled.

Further, the conventional front loader has been provided with either a single-acting or a double-acting lift cylinder for lifting and lowering the arm, but both cylinders have their merits and demerits from the standpoint of function, often causing much inconvenience to the operator depending upon working conditions. Therefore, it is desirable for a single front loader to have both functions from the standpoint of efficiency of operation and rate of operation.

SUMMARY OF THE INVENTION

The present invention provides a hydraulic circuit control system comprising first and second double-acting cylinders each having a rod-side chamber and a piston-side chamber, a hydraulic pump for supplying pressure oil to said double-acting cylinders, and directional control valves for controlling the supply of pressure oil to said cylinders, said system having a first circuit means for independently operating the individual cylinders and also a second circuit means for causing the rod advancing and retracting actions of the first cylinder to be followed by the rod advancing and retracting actions of the second cylinder.

According to an embodiment of the invention, the second circuit means of the hydraulic circuit control system includes a first oil passage for feeding the oil in the rod-side chamber of the first cylinder to the piston-side chamber of the second cylinder when the rod of the first cylinder is being advanced, a second oil passage having a restrictor for returning the oil in the rod-side chamber of the second cylinder to a tank during said advance, a third oil passage for feeding the oil in the piston-side chamber of the first cylinder to the rod-side chamber of the second cylinder when the rod of the first cylinder is being retracted, a fourth oil passage branching from the last-mentioned oil passage and having a restrictor leading to the tank, and a fifth oil passage for returning the oil in the piston-side chamber of the second cylinder to the tank.

The restrictor through which the return oil from the rod-side chamber of the second cylinder passes during advance of the rod of the first cylinder may be controlled by a pilot pressure derived from the oil passage which connects the rod side of the first cylinder to the piston-side chamber of the second cylinder.

According to another embodiment of the invention, the hydraulic control circuit system is constructed such that a check valve for blocking the return oil from the piston-side chamber of the first cylinder and a valve controlled by a pilot pressure derived from the oil passage leading to the rod-side chamber of the first cylinder are arranged in parallel with each other in the oil passage which connects the first cylinder to a directional control valve associated therewith, while a check valve which blocks the return oil from the rod-side chamber of the second cylinder and a valve controlled by a pilot pressure derived from the oil passage leading to the piston-side chamber of the second cylinder are arranged in parallel with each other in the oil passage which connects the directional control valve for the first cylinder to the directional control valve for the second cylinder.

Such pilot operated valve is provide with a fixed restrictor and may be a brake valve which opens in response to a predetermined pressure or a flow control valve, such as a slow return valve.

In any of the embodiments of the invention described above, the hydraulic control circuit system may be provided with a speed up device adapted to increase the rod advancing speed of the second cylinder by transferring the oil in the rod-side chamber of the second cylinder when the rod of the latter is advanced.

The speed up device comprises, by way of example, a first oil passage connected to an oil passage leading to the rod-side chamber of the second cylinder, a second oil passage connected to the oil passage leading to the piston-side chamber of the second cylinder, a check valve placed in said first oil passage for blocking the return oil from the rod-side chamber of said cylinder, a circulation valve disposed between said first and second oil passages and movable between a first position where it establishes the communication between said first and second oil passages and a second position where it blocks said communication, a spring normally urging said circulation valve to said second position, a pilot oil passage extending from the first oil passage for moving said circulation valve against the force of the spring when the pressure in the second oil passage exceeds a predetermined value, and a restrictor bypassing said check valve.

The speed up valve may be provided with a changeover mechanism adapted to selectively connect the rod-side chamber of the second cylinder to the tank or to the piston-side chamber of said cylinder when the rod of the second cylinder is advanced. The changeover device may, in the above case, be arranged to open the check valve when necessary.

According to a further embodiment of the invention, the hydraulic control circuit system may be provided with a device for changing over the first cylinder from single action to double action and vice versa.

In a more advantageous embodiment of the invention, the hydraulic control circuit system includes a single operating lever for manipulating through an input transmission mechanism a pair of directional control valves associated with first and secnd double-acting cylinders.

These and other features of the invention will become more apparent from the following description given with reference to the accompanying drawings.

BRIEF DESCRIPTION OF THE DRAWINGS

FIG. 11A shows a neutral state and FIG. 11B shows a rod advanced state;

DESCRIPTION OF THE PREFERRED EMBODIMENTS

Figure 1:
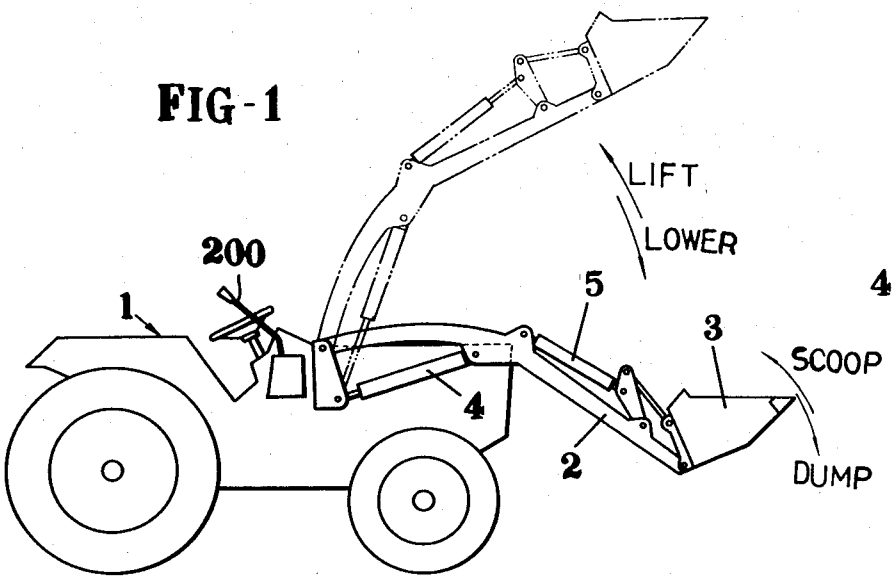
FIG. 1 is a side elevation of a tractor equipped with a front loader with the present invention applied thereto.

In FIG. 1, the numeral 1 denotes a tractor equipped with a front loader with the present invention applied thereto. The front loader comprises an arm 2 pivotally connected at one end thereof to the tractor 1, and a working implement 3 pivotally supported on the other end of the arm 2. The arm 2 is upwardly and downwardly turned (or lifted and lowered, as indicated by arrows) in a vertical plane by the advance and retraction of the rod of a lift cylinder 4 associated with said arm. The working implement 3 is upwardly and downwardly turned (or caused to scoop and dump, as indicated by arrows) in a vertical plane by the advance and retraction of the rod of a dump cylinder 5 associated with said working implement. The rod of the dump cylinder 5 is connected to the working implement 3 either directly or through a link mechanism as shown. The working implement depicted as a bucket 3 will hereinafter be described as a bucket. Actually, however, any one of various attachments, such as bucket and fork, that is suitable for a particular intended operation will be removably attached to the front end of the arm 2. In addition, the lift and dump cylinders 4 and 5 seem to be present only one each, but, actually, there is one more each on the opposite side. However, the description will be made herein with the assumption that there is one each for the sake of convenience.

Hydraulic control circuit systems for controlling the rod advancing and retracting actions of the lift and dump cylinders 4 and 5 will be described below as concrete examples of the invention.

Figure 2:
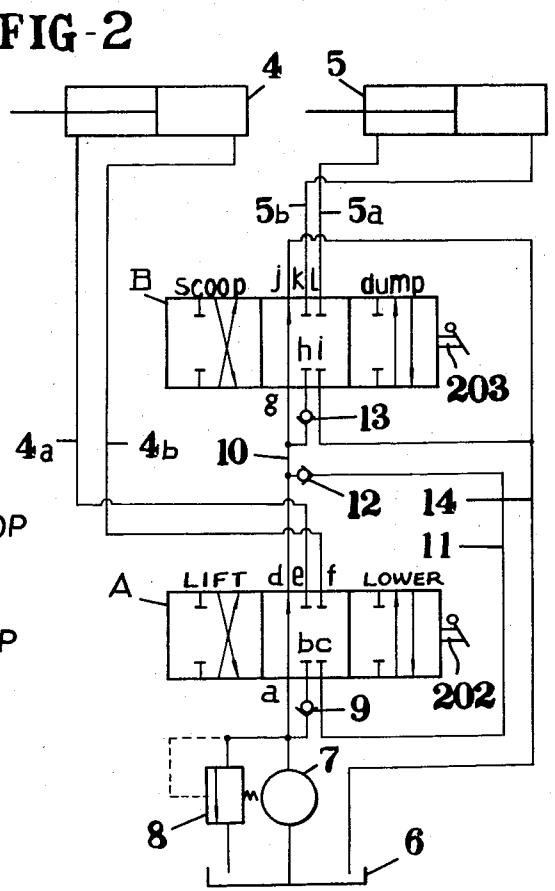
FIG. 2 is a circuit diagram showing a hydraulic control circuit system according to a embodiment of the invention.

A hydraulic control circuit system shown in FIG. 2 comprises an oil storage tank 6, a hydraulic pump 7 driven by the driving engine (not shown) of the tractor 1 through a suitable power take off mechanism, a relief valve 8 for maintaining at a predetermined value the supply pressure of oil from the hydraulic pump 7, and a directional control valve A for the lift cylinder 4 and a directional control valve B for the dump cylinder 5. The directional control valve A for the lift cylinder 4 is a manual 6-port 3-position changeover valve having three changeover positions corresponding to the up, neutral and down of the arm and also having three ports a, b and c on the pump side and three ports d, e and f on the cylinder side. The directional control valve B for the dump cylinder is a manual 6-port 3-position changeover valve having three changeover positions corresponding to the scoop, neutral and dump of the bucket 3 and also having three ports g, h and i on the pump side and three ports j, k and l on the cylinder side.

The directional control valves A and B are at neutral in the state shown in FIG. 2, wherein the pressure oil being supplied from the hydraulic pump 7 is returning to the tank via the now-communicating ports a and d of the valve A, a hydraulic passage 10, the communicating ports g and j of the valve B, and a line 14, so that the system is in the neutral state where neither the arm 21 nor the bucket 3 is operating.

With the direction control valve B for the dump cylinder 5 held in the neutral position, if the directional control valve A for the lift cylinder 4 is changed over to upward movement, the pressure oil from the pump 7 pushes a check valve 9 open to admit the pressure oil into the port b of the valve A, from which it flows through the port f and then through the line 4*b* to enter the piston-side chamber of the lift cylinder 4, whereby the rod of the lift cylinder is advanced to turn the arm 2 upwardly. During this operation, the oil in the rod-side chamber of the lift cylinder 4 returns to the tank successively through the line 4*a*, the port e and c of the valve A, the line 11 having a check valve 12, the port g and j of the valve B, and the line 14. Reversely, if the valve A is shifted to the lowering position, the operation proceeds in an anologous manner but in this case since the direction of supply of pressure oil to the cylinder 4 is reversed, the rod of the cylinder 4 is retracted, thus turning the arm 2 downwardly, as can be readily seen.

With the directional control valve A for the lift cylinder 4 held in the neutral position, if the directional control valve B for the dump cylinder 5 is shifted to the dump position, the pressure oil from the pump 7 flows into the piston-side chamber of the dump cylinder 5 successively through the ports a and d of the valve A, the oil passage 10, the ports h and k of the valve B, and the line 5*b*, so that the rod of the dump cylinder 5 is advanced to cause the bucket 3 to perform the dump action. During this operation, the oil in the rod-side chamber of the dump cylinder 5 returns to the tank successively through the line 5*a*, the ports l and i of the valve B and the line 14. Reversely, if the valve B is shifted to the scoop position, the operation proceeds in an analogous manner but in this case since the direction of supply of oil to the cylinder 5 is reversed, the rod of the cylinder 5 is retracted, thus causing the bucket 3 to perform the scoop action, as can be readily seen.

In brief, in the case of operating only one of the cylinders, if the directional control valve B for the dump cylinder is held in the neutral position and the directional control valve A for the lift cylinder is shifted to the lifting or lowering position, the lift cylinder 4 alone is actuated to lift or lower the arm 2, while if the directional control valve A for the lift cylinder is held in the neutral position and the directional control valve B for the dump cylinder is shifted to the scoop or dump position, the dump cylinder 5 alone is actuated to turn the bucket 3 upwardly or downwardly to scoop or dump earth and sand or other object to be handled.

The simultaneous operation of the arm 2 and bucket 3 is as follows. For example, if it is desired to lift the arm 2 with the bucket 3 filled with a load, in order to prevent spilling of the load it is necessary to forwardly tilt the bucket 3 in response to the upward turning of the arm 2 so as to maintain the bucket always horizontal. In such case, the directional control valve B for the dump cylinder is switched to the dump position and at the same time the directional control valve A for the lift cylinder is switched to the lifting position. As a result, the pressure oil from the hydraulic pump 7 pushes the check valve 9 open and flows through the ports b and f of the valve A and the line 4*b* and into the piston-side chamber of the lift cylinder 4, while the oil in the rod-side chamber thereof flows successively through the line 4*a*, the ports e and c of the valve A, the line 11, the ports h and k of the valve B and the line 5*b* and into the piston-side chamber of the dump cylinder 5, while the oil in the rod-side chamber of the dump cylinder 5 returns to the tank 6 through the line 5*a*, the ports l and i of the valve B and the line 14. As a result, the rod of the lift cylinder 4 is advanced to lift the arm 2 and simultaneously therewith the return oil from the lift cylinder 4 advances the rod of the dump cylinder 5 to turn the bucket 3 forwardly.

The simultaneous operation of the arm 2 and bucket 3, i.e., the concomitant interlocked operation of the bucket with respect to the operation of the arm may be performed for lifting-scooping, lowering-dumping and lowering-scooping in addition to said lifting-dumping. Such concomitant interlocked operation of one of the double-acting cylinders with respect to the other is achieved in that when the directional control valves associated therewith are simultaneously operated, the return oil from one double-acting cylinder (in the above case, the lift cylinder 4) is fed to the other double-acting cylinder (in the above case, the dump cylinder 5). Particularly in the case of a farm tractor, the concomitant interlocked operation of the bucket 3 with respect to the lift arm for lifting-dumping and lowering-scooping enables the bucket 3 to be maintained horizontal in connection with the lifting and lowering of the arm 2, so that there is no possibility of the load in the bucket spilling during the lifting and lowering of the arm 2. Further, the parallel links heretofore used for this purpose are no longer necessary. Thus, the reduced weight of the front loader and enlarged visual field from the cab contribute to maneuverability and safety.

In addition, such concomitant interlocked operation can be adjusted by adjusting the inner diameters of the cylinders 4 and 5 and the piston rod diameters.

Figure 3:
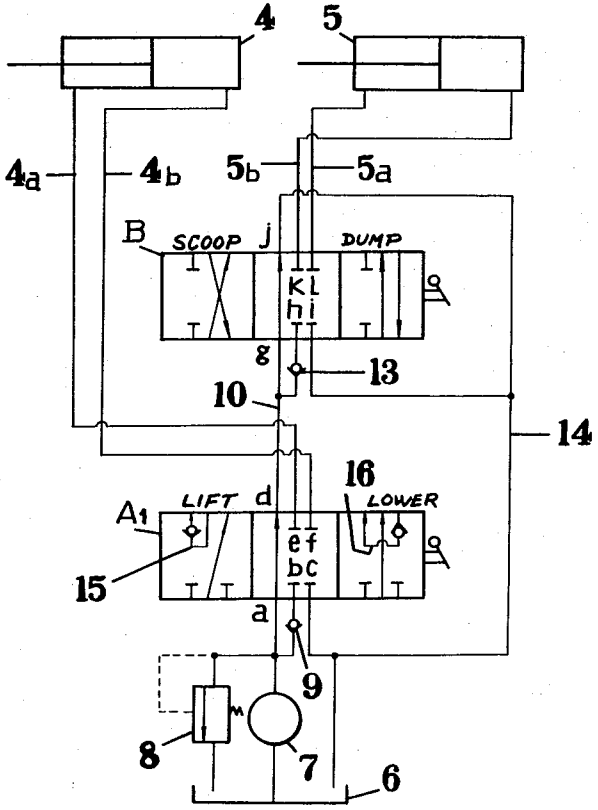
FIG. 3 is one circuit diagram showing a modification of the system shown in FIG. 2.

FIG. 3 shows a modification, wherein the line 11 having the check valve 12 shown in the system of FIG. 2 is eliminated and instead their functions are incorporated in flow passages 15 and 16 which control the direction of flow of pressure oil at the lifting and lowering positions in the directional control valve A1 for the lift cylinder. As for the operation, suffice it to say that the same results as in the preceding embodiment are obtained.

Figure 4:
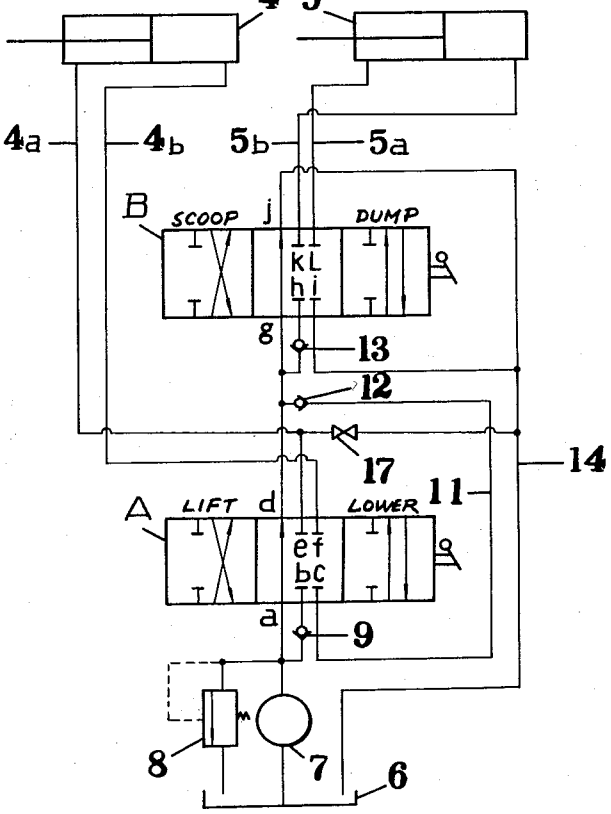
FIG. 4 is a circuit diagram showing a further modification of the system shown in FIG. 2.
Figure 5:
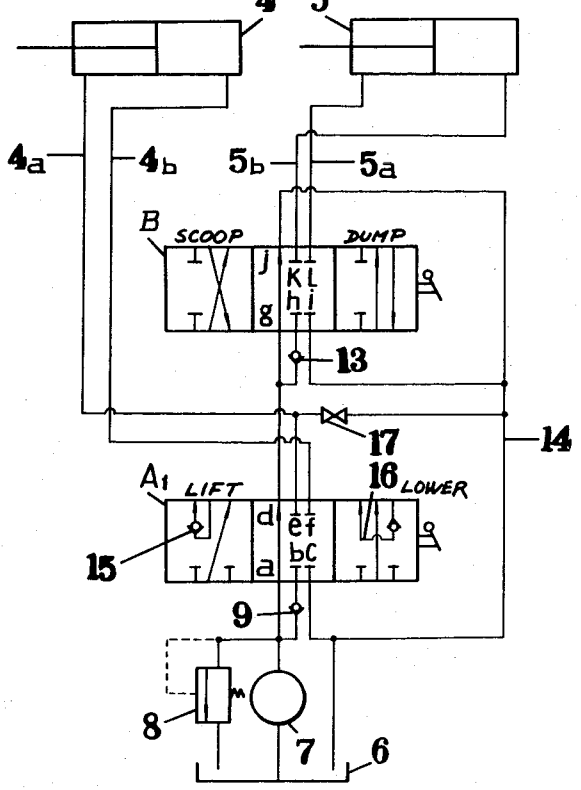
FIG. 5 is a circuit diagram showing a modification of the embodiment shown in FIG. 3.

FIGS. 4 and 5 show embodiments wherein a stop valve 17 which connects the lines 4*a* and 14 is added to the systems shown in FIGS. 2 and 3, respectively. As can be readily seen, when the stop valve 17 is closed, the functions of the systems of FIGS. 4 and 5 are the same as those of the systems of FIGS. 2 and 3, respectively. Therefore, only the system of FIG. 4 will be described with the stop valve 17 in the opened state.

With the stop valve 17 opened and the directional control valve B for the dump cylinder held in the neutral position, if the directional control valve A for the lift cylinder 4 is shifted to the lift position, the arm 2 can be lifted by the pressure oil from the hydraulic pump 7, but even if the valve is shifted to the lowering position, there is no effective pressure oil available for the rod-side chamber of the lift cylinder 4 since the line 4*a* leading to the rod-side chamber of the lift cylinder 4 is communicating via the now-opened stop valve 17 with the return pipe 14 leading to the tank 6, which means that the lift cylinder 4 operates as the single-acting type. That is, when the directional control valve A1 for the lift cylinder is shifted to the lifting position, the direction of supply of pressure oil, with the stop valve 17 closed, is such that the result is the same as in the embodiment shown in FIG. 2, with the rod of the lift cylinder 4 being advanced to lift the lift arm 2. When the directional control valve A1 for the cylinder is shifted to the lowering position, the pressure oil from the hydraulic pump 7 pushes the check valve 9 open and flows into the line 4*a* through the ports b and e of the valve A1. In fact, however, since the stop valve 17 is open, the pressure oil returns to the tank 6 via the line 14. Therefore, there is no effective pressure oil available for the rod-side chamber of the lift cylinder 4, and since the piston-side chamber is communicating with the tank 6, the rod of the lift cylinder 4 is retracted under the weight of the lift arm and bucket 3 and the weight of the load, thus allowing the lift arm to descend until the bucket 3 abuts against the ground. In such condition, the lift arm 2 can be freely turned in a vertical direction, so that it becomes possible for the tractor 1 to travel smoothly while accommodating itself to the unevenness of the ground without receiving shock. Damage to the tractor 1 and bucket 3 can thus be avoided.

With the directional control valve A1 for the lift cylinder held in the neutral position, if the directional control valve B for the dump cylinder is shifted to the scoop or dump position, the result is the same as in the operation of the dump cylinder 5 alone according to the embodiment shown in FIG. 1, so that a description thereof will be omitted.

When it is desired to drive the tractor with the bucket 3 loaded with a farm product or other scooped object, the directional control valves A1 and B are held in the neutral position. In this case, since the line 4*a* leading to the rod-side chamber of the lift cylinder 4 is communicating with the line 14 and hence with the tank 6 via the now-opened stop valve 17, the lift arm 2 can be freely turned only upwardly. As a result, vibration due to the traveling of the tractor 1 is not transmitted directly to the bucket 3, with the shock absorbed, so that the tractor 1 and the front loader are protected.

Figure 6:
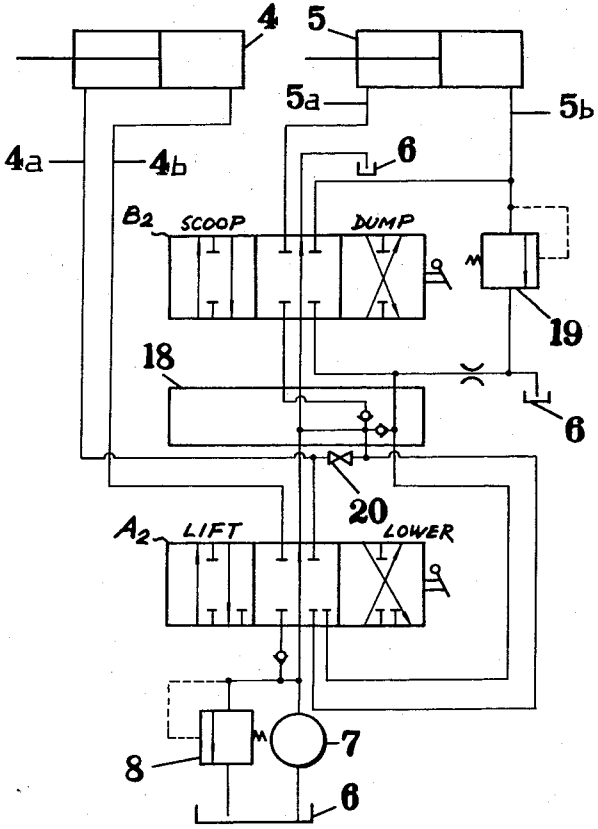
FIG. 6 is a circuit diagram showing a hydraulic circuit control system according to another embodiment of the invention.

FIG. 6 shows an embodiment of the invention, comprising a spacer 18 interposed between directional control valves A2 and B2, one more pump-side port added to the directional control valve A2 for the lift cylinder, and a port relief valve 19 placed in the line 5*b* leading to the piston-side chamber of the dump cylinder 5. Operation of this hydraulic circuit system, with the stop valve 20 closed, is substantially the same as in the preceding embodiment, but when the stop valve 20 is opened, the operation is somewhat different and this will be described below.

With the stop valve 20 opened, if the directional control valve A2 for the lift cylinder is shifted to the lifting position, the lift arm 2 will be lifted, as in the other embodiments. If it is shifted to the lowering position, with the directional control valve B2 for the dump cylinder assumed to be in the neutral position, then the pressure oil from the pump 7 is leading to the rod-side chamber of the lift cylinder 4, but since the line 4*a* leading to said rod-side chamber is communicating with the tank via the now-opened stop valve 20 and spacer 18, there is no effective hydraulic pressure available for the rod-side chamber of the lift cylinder 4. Further, since the piston-side chamber of the lift cylinder 4 is also leading to the tank 6 via the line 4*b* and spacer 18, the lift arm descends by gravitation until the bucket 3 abuts against the ground. Thereafter, the lift arm can be freely vertically turned to allow the bucket 3 to follow the unevenness of the ground.

In the above-described condition where the directional control valve A2 for the lift cylinder is in the lowering position, even if the directional control valve B2 for the dump cylinder is shifted to the dump or scoop position, it is possible to operate the dump cylinder 5 in connection with the lift cylinder 4 and hence move the bucket 3 in connection with the lift arm 2. This is a feature peculiar to this embodiment.

With the stop valve 20 opened, if the directional control valves A2 and B2 are shifted to the neutral position, the lift arm 2 can be freely turned only upwardly and thanks to the presence of the port relief valve 19 the bucket 3 can move in the direction of rod retraction of the dump cylinder 5 when an external force greater than a predetermined pressure acts. In addition, with the stop valve 20 opened, if the valve A2 is shifted to the neutral position and the valve B2 to the dump or scoop position, the pressure oil from the pump 7 flows into the rod-side chamber of the lift cylinder 4 via the stop valve 20, but since the piston-side chamber of the lift cylinder 4 is locked by the lock port of the directional control valve A2 held in the neutral position, the lift cylinder does not operate and the dump cylinder alone can be operated as desired.

In brief, this embodiment is intended for operation of the lift cylinder 4 alone in that with the stop valve 20 closed the lift cylinder 4 acts as a double-acting cylinder and with the stop valve 20 opened it acts as a single-acting cylinder. With the lift cylinder 4 acting as a single-acting cylinder, as can be seen from the operation of the lift cylinder 4, there is no excessive force imposed on the tractor, so that damage to the tractor and front loader can be avoided. Further, since the tractor can be driven in a floating condition allowing the bucket 3 to follow the unevenness of the ground, the shock produced during travel while doing materials-handling is absorbed, thus improving maneuverability and safety and preventing the front wheels of the tractor from floating up. Thus, in the case of a four wheel driven tractor, its traction can be fully developed. In the case of a lift arm mounted type front loader, if the lift cylinder is rendered single-acting, this facilitates the attachment to and detachment from the tractor of the lift arm. The front wheel of the tractor can be held floating with the lift cylinder and hence the lift arm locked, thus facilitating escape from muddy places and adjustment of the front wheel tread. The switching of the lift cylinder 4 between single action and double action needs only to operate the stop valves 17 and 20, as described above. Thus, the range of materials handling can be broadened by selecting either of the types of action, so that the rate of operation of the tractor can be increased. The two functions of single and double actions can be developed in a single tractor.

Figure 7:
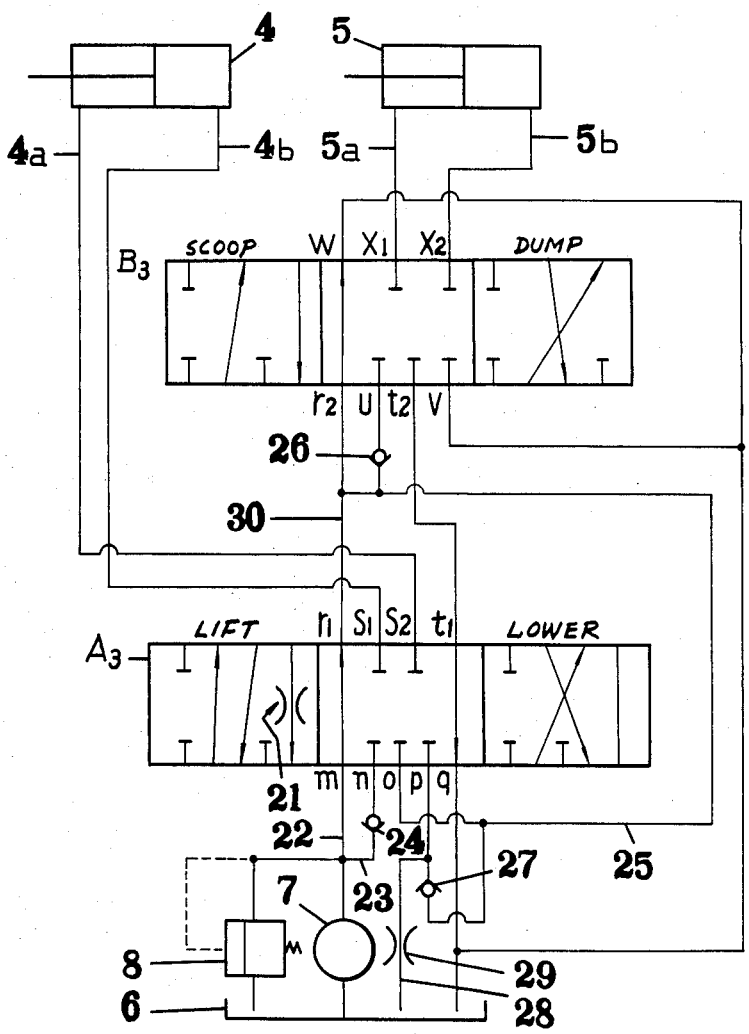
FIG.7 is a circuit diagram showing a hydraulic control circuit system according to a further embodiment of the invention.

FIG. 7 shows an improved embodiment, wherein in the hydraulic circuit system capable of operating two cylinders individually or simultaneously as described above, not only smooth simultaneous operation of both cylinders but also satisfactory individual operation of either cylinder can be ensured.

FIG. 7 shows a no-load neutral state in which directional control valves A3 and B3 are in the neutral position, with the pressure oil from the hydraulic pump 7 returning to the tank 6 via the line 22, the neutral ports m and r1 of the valve A3, the oil passage 30 and the neutral ports r2 and w.

If one of the directional control valves A3 and B3 is operated with the other held in the neutral position, the rod advance or retraction of the corresponding cylinder is effected and the manner of operation is the same as the previously described or conventional one except the following: In this embodiment, when the lift arm 2 is lowered with the valve A3 held in the lowering position, some of the return oil from the piston-side chamber of the cylinder 4 returns to the tank 6 via a branch oil passage having a restrictor 29, making it unnecessary for all the return oil to pass through a long passage including an oil passage 25, thus reducing the pressure loss so as to increase the rod retracting speed of the cylinder 4.

The operation involving the simultaneous use of the directional control valves A3 and B3 is as follows.

With the directional control valve A3 for the lift cylinder held in the lifting position, if the directional control valve B3 for the dump cylinder is shifted to the scoop position, the pressure oil from the hydraulic pump 7 flows (through the oil passage 23, pushing the check valve 24 open, into the pressure oil port n and then into the cylinder port s1 communicating therewith, and through the oil passage 4*b*) and into the piston-side chamber of the lift cylinder 4, during which time the oil in the rod-side chamber of the cylinder 4 passes (through the oil passage 4*a* to enter the cylinder port s2, flowing through the first series port o communicating therewith, and then through the oil passage 25 and check valve 26 and into the pressure oil port u of the valve B3 and then passes through the cylinder port x1 communicating therewith and then through the line 5*a*) to flow into the rod-side chamber of the dump cylinder 5. At the same time, the oil in the piston-side chamber of the cylinder 5 returns to the tank 6 by passing successively through the line 5*b* and the cylinder port x2 and tank port v of the valve B3. Thus, the rod advancing action of the lift cylinder 4 and the rod retracting action of the dump cylinder 5 take place at the same time in operative association with each other.

With the directional control valve A3 for the lift cylinder held in the lifting position, if the directional control valve B3 for the dump cylinder is shifted to the dump position, the pressure oil from the hydraulic pump 7 flows into the piston-side chamber of the lift cylinder 4 successively through the line 23, the check valve 24, the pressure oil port n and cylinder port s1 of the valve A3 and the line 4*b* and at the same time the oil in the rod-side chamber of the cylinder 4 flows into the piston-side chamber of the dump cylinder 5 via a first oil passage leading successively through the line 4*a*, the cylinder port s2 of the valve A3, the first series port o, the oil passage 25, the check valve 26, the pressure oil port u and cylinder port x2 of the valve B3 and the line 5*b*, while the oil in the rod-side chamber of the dump cylinder 5 returns to the tank 6 via a second oil passage leading successively through the line 5*a*, cylinder port x1 and return port f2 of the valve B3, the return port t1 of the valve A3, the restrictor 21 and the tank port q. Thus, the cylinders 4 and 5 operate at the same time in the rod advancing direction in operative association with each other. In this case, since the return oil from the rod-side chamber of the dump cylinder is back-pressure controlled by the restrictor 21, the rod advancing action of the lift cylinder 4 also is consequently back-pressure controlled. Therefore, the rod advancing actions of the cylinders 4 and 5 are fully associated with each other. That is, the amount of rod advance of the dump cylinder 5 exactly corresponds to the amount of rod advance of the lift cylinder 4, so that even when the load on the dump cylinder 5 acts in the direction of rod advance, it is constrained by the rod advancing action of the lift cylinder 4, preventing the rod from advancing rapidly under the load and the self-weight to the extent that the piston-side chamber of the dump cylinder 5 has a vacuum produced therein.

With the directional control valve A3 for the lift cylinder shifted to the lowering position and the directional control valve B3 for the dump cylinder shifted to the scooping position, the pressure oil from the hydraulic pump 7 is fed into the rod-side chamber of the lift cylinder 4 successively through the line 23 with the check valve 24, the pressure oil port n and cylinder port s2 of the valve A3 and the line 4*a*, while the oil in the piston-side chamber of the lift cylinder 4 flows into the rod-side chamber of the dump cylinder 5 via a third oil passage leading successively through the line 4*b*, cylinder port s1 and second series port p of the valve A3, the check valve 27, the oil passage 25, the check valve 26, the pressure oil port u and cylinder port x1 of the valve B3 and the line 5*a*, and while the oil in the piston-side chamber of the dump cylinder 5 returns to the tank 6 via a fifth oil passage leading successively through the line 5*b* and the cylinder port x2 and tank port v of the valve B3. Thus, the two cylinders 4 and 5 perform rod retracting action. In this case, some of the oil in the piston-side chamber of the lift cylinder 4 returns to the tank 6 via a fourth oil passage leading through the oil passage 28 having the restrictor 29 and branching off from the oil passage between the second series port p of the valve A3 and the check valve 27, so that even when the dump cylinder 5 is in the maximum rod retracting state in the course of or at the start of operation, the rod retracting action of the lift cylinder 4 can be performed without trouble. Particularly with the two cylinders 4 and 5 loaded in the rod retracting direction, even if the dump cylinder 5 assumes the maximum rod advancing state in the course of operation, the restrictor 29 in the branch oil passage 28 acts as a bleed-off hole, preventing the generation of surge pressures. Further, the presence of this branch oil passage 28 reduces pressure loss during simultaneous retraction of the rods and increases the rod retracting speed of the lift cylinder 4.

Figures 8, 9:
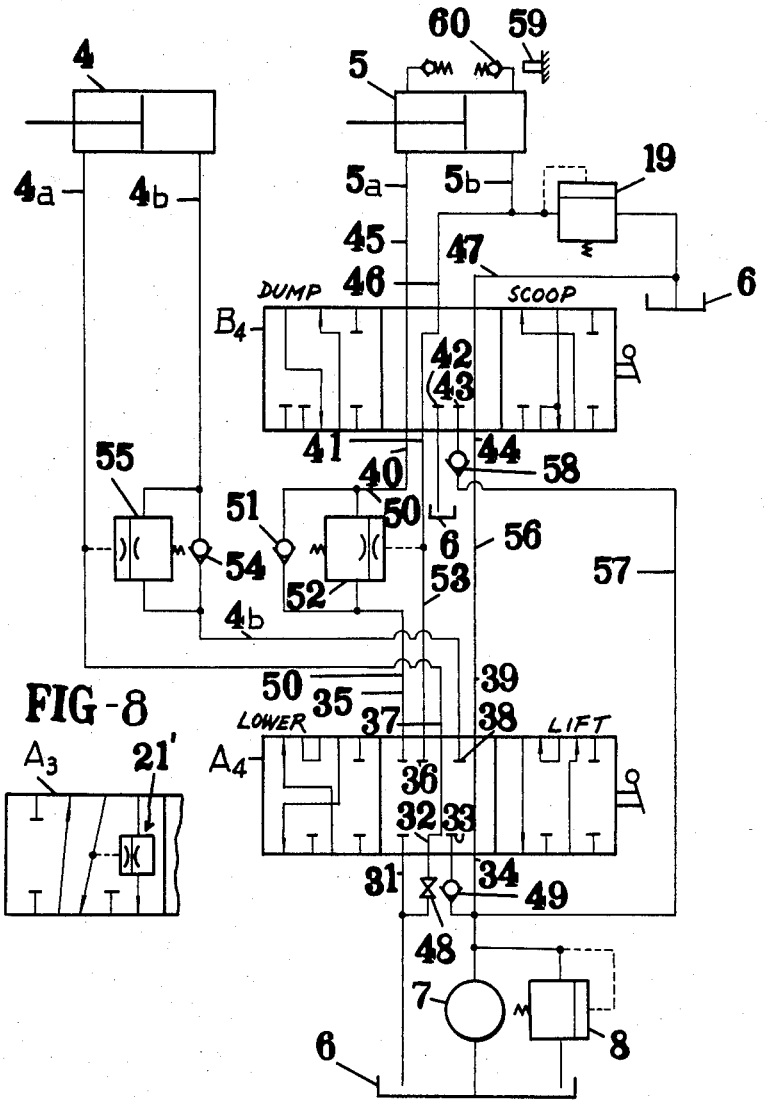
FIG. 8 is an enlarged fragmentary view showing a modification of the embodiment shown in FIG. 7.
FIG. 9 is a circuit diagram showing a hydraulic control circuit system according to another embodiment of the invention.

FIG. 8 shows an embodiment of the invention wherein the restricting mechanism 21 in the embodiment shown in FIG. 7 is modified. The return port t1 and tank port q of the directional control A3 in the lifting position are connected together by a flow control mechanism 21' which acts to establish the communication between said ports when a pilot pressure derived from a communication passage extending between the cylinder port s2 and first series port o of said valve exceeds a predetermined pressure In other words, the restriction 21 of FIG. 7 in the modification of FIG. 8, is controlled by a pilot pressure derived from the said first oil passage, as indicated at 21'.

The individual operation with either of the oylinders 4 and 5 held in the neutral position is no different from that of the embodiment shown in FIG. 7. In cases where these cylinders 4 and 5 are simultaneously operated, e.g., with the directional control valve A3 for the lift cylinder shifted to the lifting position and the directional control valve B3 for the dump cylinder shifted to the dump position, the pressure oil from the hydraulic pump 7 flows into the piston-side chamber of the lift cylinder 4 successively through the oil passage 23 with the check valve 24, the pressure oil port n and cylinder port s1 and the line 4*b*, while the oil in the rod-side chamber flows into the piston-side chamber of the dump cylinder 5 successively through the line 4*a*, the cylinder port s2 and first series port o of the valve A3, the communication oil passage 25, the check valve 26, the pressure oil port u and cylinder port X2 of the valve B3, and the line 5*b*, and while the oil in the rod-side chamber of the dump cylinder 5 returns to the tank 6 successively through the line 5*a*, the cylinder port x1 and return port t2 of the valve B3, the return port t1 of the valve A3, the flow control mechanism 21', and the tank port q. Thus, with the rods of the two cylinders 4 and 5 advancing and with the lift arm 2 lifting, the bucket 3 performs dump action.

The flow control mechanism 21' initially blocks the communication between the return port t1 and tank port q, so that the return oil from the rod-side chamber of the dump cylinder 5 cannot return to the tank 6 and the flow of oil in the hydraulic circuits is prevented, with none of the cylinders 4 and 5 operating. The pressure in the hydraulic circuits increases until the pilot pressure for the flow control mechanism 21' exceeds a predetermined value, whereupon the flow control mechanism 21' establishes the communication between the return port t1 and the tank port q, allowing the oil from the rod-side chamber of the lift cylinder 4 to return to the tank 6, producing the desired flow of oil in the hydraulic circuits. In this way, only when the lift cylinder 4 advances its rod at a pressure above a predetermined value, the dump cylinder also advances its rod. Thus, the interlocked operation of the two cylinders is achieved.

Therefore, even when the load on the dump cylinder 5 acts in the rod advancing direction, the rod advancing action of the dump cylinder is constrained by the rod advancing action of the lift cylinder 4, thus preventing the bucket 3 from rapidly forwardly tilting owing to increased load. That is, if a rapid rod advancing action of the dump cylinder 5 takes places, the piston-side chamber of said cylinder has a vacuum produced therein, thus rapidly drawing oil from the rod-side chamber of the lift cylinder 4, with a consequent reduction in oil pressure in the hydraulic circuits. Therefore, the pilot pressure for the flow control mechanism 21' also reduces until the flow control mechanism 21' blocks the communication between the return port t1 and tank port q, no longer allowing the oil in the rod-side chamber of the dump cylinder 5 to return to the tank 6, making it impossible for the rod of the dump cylinder 5 to further advance. Also when a load in the rod retracting direction acts on the lift cylinder 4 to stop the rod advancing action of the lift cylinder 4, the flow control mechanism 21' likewise operates to inhibit the rod advancing action of the dump cylinder 5.

In this way, the hydraulic control circuit system of this embodiment prevents rapid rod advance of the dump cylinder even when a load in the rod advancing direction acts on the dump cylinder when the rods of the two cylinders are advanced, thereby preventing the rod-side chamber of the dump cylinder from having a vacuum created therein. A composite simultaneous operation in which the rates of rod advance of the two cylinders are theoretically equal is possible, so that when it is desired to operate the bucket while lifting the lift arm, their stabilized leveling becomes possible. Further, in the simultaneous rod retracting operation of the two cylinders, even if the dump cylinder assumes the most retracted state and is subjected to the weight of the load, there is no possibility of surge pressures being produced and thanks to the bleed-off action of the branch circuit 28 with the restrictor 29 it is possible to allow the lift cylinder to continue the rod retracting action. As a result, the bucket can be lowered with the load contained therein and smooth efficient materials handling operation is carried out without spilling of load.

FIG. 9 shows a hydraulic circuit system according to a further embodiment of the invention. The directional control valve A4 for the lift cylinder is a 3-position 9-port manual changeover valve capable of selectively assuming three positions, lifting, neutral and lowering and having 4 ports 31, 32, 33, 34 disposed on the pump side and 5 ports 35, 36, 37, 38, 39 disposed on the cylinder side. The directional control valve B4 for the dump cylinder is a 3-position 8-port manual changeover valve capable of selectively assuming three positions, scoop, neutral and sump and having 5 ports 40, 41, 42, 43, 44 disposed on the pump side and 3 ports 45, 46, 47 disposed on the cylinder side.

In the state shown in FIG. 9, the directional control valves A4 and B4 have assumed the neutral position. In this state, the line 4*b* leading to the piston-side chamber of the lift cylinder 4 is blocked by the port 38, while the line 4*a* leading to the rod side chamber is connected to the tank 6 through the ports 37, 32 and stop valve 48. The way the hydraulic circuits change owing to the opening and closing of the stop valve 48 is the same as that described with reference to FIGS. 4 and 5, and a similar result is obtained. Further, the lines 5*a* and 5*b* leading to the rod-side and piston-side chambers of the dump cylinder 5 are blocked by the port 35 of the valve A4. A port relief valve 19, as described above, is provided in the line 5*b*.

With the directional control valve B4 for the dump cylinder held in the neutral position, if the directional control valve A4 for the lift cylinder is shifted to the lifting position, the pressure oil from the pump 7 pushes the check valve 49 open and flows into the piston-side chamber of the lift cylinder through the ports 33 and 38 of the valve A4 and the check valve 54, so that the rod of the cylinder 4 is advanced to lift the lift arm 2. During this operation, the oil in the rod-side chamber of the lift cylinder 4 flows into the piston-side chamber of the dump cylinder 5 successively through the line 4*a*, the ports 37 and 36 of the valve A4, the oil passage 53, the ports 41 and 46 of the valve B, and the line 5*b*, while the oil in the rod-side chamber of the dump cylinder 5 returns to the tank 6 successively through the line 5*a*, the ports 45 and 40 of the valve B4, the line 50, the brake valve 52, and the ports 35 and 31 of the valve A4. The brake valve 52 is adapted to be opened by the return oil from the rod-side chamber of the lift cylinder 4 which is fed into the piston-side chamber of the dump cylinder 5, thereby causing the lift cylinder 4 to advance its rod and concomitantly therewith the rod of the dump cylinder 5 is advanced, so that as the lift arm 2 is lifted, the bucket 3 is forwardly tilted to be maintained horizontal.

With the directional control valve B4 for the dump cylinder held in the neutral position, if the directional control valve A4 for the lift cylinder is shifted to the lowering position, the pressure oil from the pump 7 flows into the rod-side chamber of the dump cylinder 5 successively through the ports 33 and 35 of the directional control valve A4, the oil passage 50, the check valve 51, the ports 40 and 45 of the directional control valve B4 for the dump cylinder, and the line 5*a*, while the oil in the piston-side chamber of the dump cylinder 5 flows into the rod-side chamber of the lift cylinder 5 successively through the line 5*b*, the ports 46 and 41 of the directional control valve B4 for the dump cylinder, the oil passage 53, the ports 36 and 37 of the directional control valve A4, and the line 4*a*. During this, the line 4*b* leading to the piston-side chamber of the lift cylinder 4 has been connected to the ports 38 and 31 of the valve A4 leading to the tank 6. The brake valve 55 placed in the line 4*b* uses the pressure in the line 4*b* as pilot pressure and remains open all the while the return oil from the piston-side chamber of the dump cylinder 5 is being fed into the rod-side chamber of the lift cylinder 4 via the line 4*a*, so that the concomitant interlocked operation of one of the cylinders 4 and 5 with respect to the other is ensured.

With the bucket 3 in the maximum dump state, if the lift arm 4 is to be lifted, the directional control valve B4 for the dump cylinder must be shifted to the neutral position and the directional control valve A4 for the lift cylinder to the lifting position. Then, the pressure oil from the rod-side chamber flows into the piston-side chamber of the dump cylinder 5, but since the dump cylinder 5 is in the maximum rod extension state, such state is maintained and the oil which has flowed into this piston-side chamber returns to the tank 6 through the port relief valve 19.

When it is desired to lower the lift arm 2 with the bucket 3 in the maximum scoop state, the directional control valve B4 for the dump cylinder is held in the neutral position and the directional control valve A4 for the lift cylinder is shifted to the lowering position. Then, the pressure oil from the pump 7 is fed into the rod-side chamber of the dump cylinder 5, but since the dump cylinder 5 is in the maximum rod retracted state and the portion 59 associated with the piston opens one of the check valves 60, the oil fed into this rod-side chamber flows into the rod-side chamber of the lift cylinder 4 through the lines 5*b* and 4*a*. In this case also, the lift arm 2 is lowered while being subjected to the action of the brake valve 55. In addition, such brake valve may be replaced by a slow return valve or other flow control valve.

Figure 10:
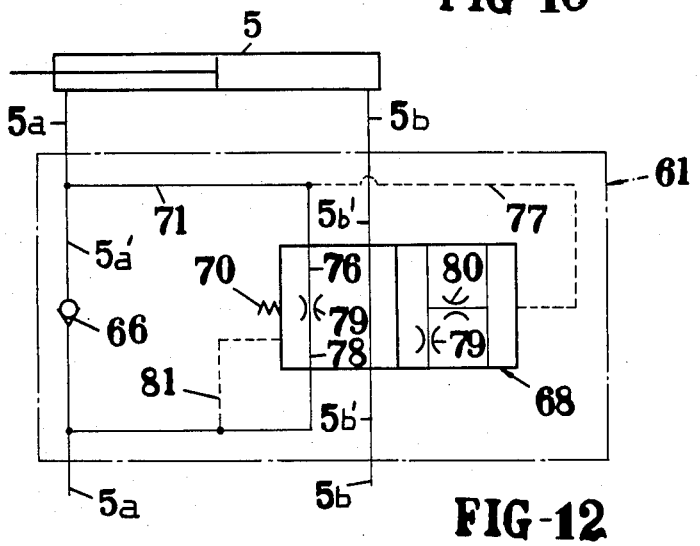
FIG. 10 is a circuit diagram showing an example of a speed up device.
Figure 11B:
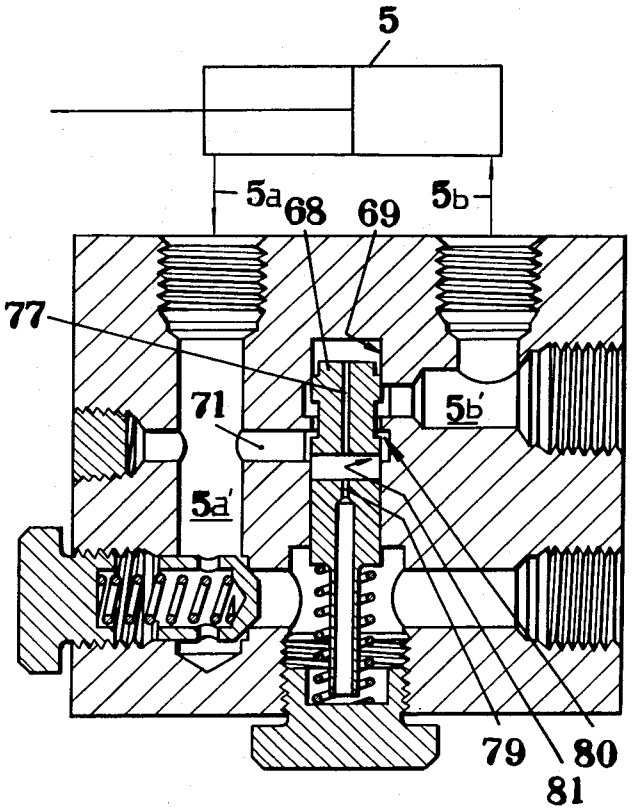
FIGS. 11A and 11B are circuit diagrams showing concrete examples of the speed up device of FIG. 10.
Figure 11A:
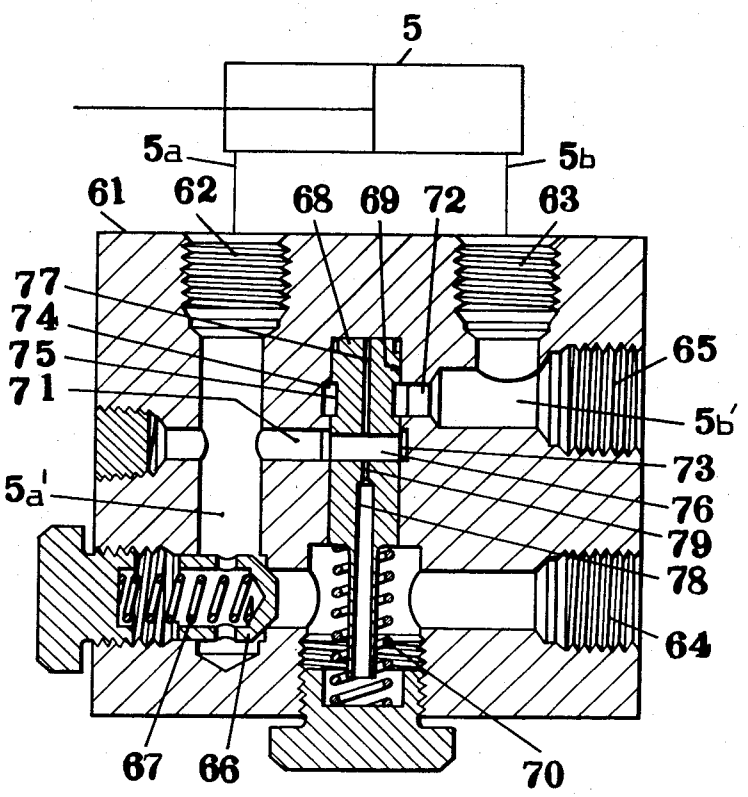

FIGS. 10, 11A and 11B show a speedup device 61 provided between the lines 5*a* and 5*b* leading respectively to the rod-side and piston-side chambers of the dump cylinder 5 for the purpose of increasing the rod advancing speed of the dump cylinder 5.

The speedup device 61 comprises ports 62 and 63 connected to the lines 5*a* and 5*b* leading to the rod-side and piston-side chambers of the dump cylinder 5, and ports 64 and 65 selectively connected to the hydraulic pump and tank through the directional control valve for the dump cylinder. The port 62 is connected to the port 64 through a first oil passage 5*a*′ having a check valve 66 loaded by a spring 67 for preventing the flow of oil toward the port 64. The port 63 communicates with the port 65 through an oil passage 5*b*′.

A circulation valve 68 for returning the return oil from the rod-side chamber of the dump cylinder 5 when the latter advances its rod is of the spool type and axially slidably fitted in a hole 69 and urged upwardly (as viewed in FIGS. 11A–11B) by a spring 70. Holes 71 and 72 communicating with the first and second oil passages 5*a*′ and 5*b*′ open, at annular recesses 73 and 74, to said hole 69, and in association therewith the circulation valve 68 has a smaller diameter portion 75 and a transverse throughgoing hole 76. It also has an axially extending pilot oil passage 77 which opens to said throughgoing hole at one end of the the circulation valve 68, and an oil passage 78 which opens to said hole 76 at the other end of the circulation valve.

When it is desired to cause the cylinder 5 to retract its rod, the directional control valve for the dump cylinder is operated so as to connect the line 5*a* to the tank. Then, the pressure oil from the hydraulic pump is fed to the port 64, pushes open the check valve 66 in the first oil passage 5*a*′ against the force of the spring 67 and flows into the rod-side chamber of the cylinder 5 through the port 62 and line 5*a*, while the oil in the piston-side chamber returns to the tank through the line 5*b*, the port 63, the second oil passage 5*b*′ and the port 65, so that the cylinder 5 performs rod retraction at the normal speed.

If the directional control valve is changed over into reverse relation, the pressure oil from the pump flows into the piston-side chamber of the cylinder 5 successively through the port 65, the second oil passage 5*b*′, the port 63, and the line 5*b*, while since the first oil passage 5*a*′ is blocked by the check valve 66, a small portion of the oil in the rod-side chamber is allowed to return to the tank through the oil passage 71, the transverse throughgoing hole 76 in the circulation valve 68, the oil passage 78 with the restrictor 79, and the port 64. As a result, the pressure in the rod-side chamber of the cylinder 5 gradually increases, such pressure rise producing a force which acts through the pilot oil passage 77 on the end surface of the circulation valve 68 and pushes back the circulation valve 68 against the force of the spring 70, whereby, as shown in FIG. 11B, the smaller diameter portion 75 of the circulation valve 68 bridges over the annular recesses 74 and 73 to establish the communication between the oil passages 5*a*′ and 5*b*′. Thus, although part of the return oil from the rod-side cylinder 5 returns to the tank via the oil passage 78 having the restrictor 79, the greater part joins the supply pressure oil from the pump which is flowing from the second oil passage 5*b*′ into the piston-side chamber, so that the rod of the cylinder 5 is advanced at an increased speed.

In this case, the communication between the annular recesses 73 and 74 provided by the smaller diameter portion 75 of the circulation valve 68 is controlled by balance of forces acting on the ends of the circulation valve 68 and the valve stops moving such that the degree of opening of a variable restrictor 80 formed between the upper edge of the annular recess 73 and the lower edge of the smaller diameter portion 75 and the degree of opening of a variable restrictor 81 formed between the lower edge of the annular recess 73 and the upper edge of the transverse throughgoing hole 76 are maintained in a given relation. That is, if the degree of opening of the variable restrictor 81 becomes zero, the pilot pressure in the pilot oil passage also becomes zero, so that there is no possibility of the same being completely closed. Thus, if the supply oil pressure from the pump is constant and there is no variation in load, the relation of degrees of opening of these variable restrictors 80, 81 is maintained constant, so that there is no danger of the circulation valve 68 chattering.

Further, if the supply of oil is stopped by the directional control valve, it is possible to bring the operation of the cylinder 5 to a sudden stop.

In addition, if the amount of supply oil is reduced by reducing the RPM of the hydraulic pump by manipulating the engine throttle valve, the pressure rise of the return oil from the rod-side chamber of the cylinder slows down, allowing part of said oil to return to the tank, so that the rod advancing speed of the cylinder is reduced.

Figure 12:
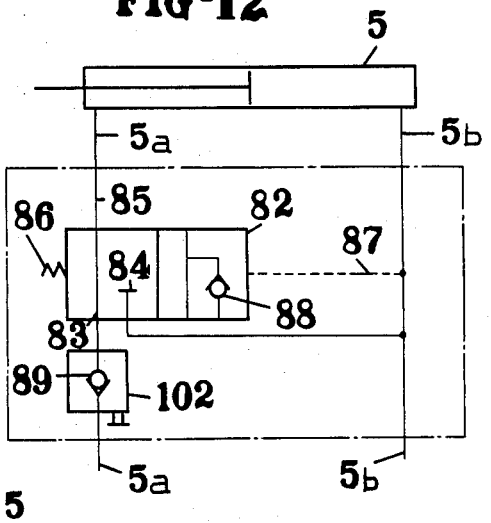
FIGS. 12 through 16 are circuit diagrams showing various modifications of the speed up device.

A modification of the speedup device shown in FIG. 12 includes a circulation valve 82 which has three ports, namely, ports 83 and 84 connected to the cylinder ports of the directional control valve for the dump cylinder, and a port 85 connected to the rod-side chamber of the dump cylinder 5, said port 84 also communicating with the piston-side chamber of the dump cylinder 5, and said port 83 being connected to the directional control valve through a check valve 89. This circulation valve 82 is a 3-port 2-position type automatic changeover valve normally urged by a spring 86 to assume a position where the ports 83 and 85 communicate with each other and the port 84 is blocked. When the pressure in the pilot circuit 87 derived from the piston-side chamber of the dump cylinder sufficiently increases to overcome the force of the spring, said valve assumes another position where the ports 84 and 85 are connected to each other through the check valve 86 and the port 83 is blocked.

In operation, if the line 5*a* is connected to the pump and the line 5*b* to the tank, there is no oil pressure produced in the pilot oil passage 87, so that the circulation valve 82 is held by the spring 86 in the illustrated position where the ports 83 and 85 communicate with each other. Therefore, the pressure oil from the pump flows into the rod-side chamber of the dump cylinder 5, while the oil in the piston-side chamber returns to the tank via the line 5*b*. Thus, the rod of the dump cylinder 5 is retracted to cause the scooping action of the bucket 3, the rod retracting speed being no different from that obtained in the absence of such speedup device.

When the line 5*b* is connected to the pump and the line 5*a* to the tank, the pressure from the pump is fed to the piston-side chamber of the dump cylinder 5, but the oil in the rod-side chamber cannot return to the tank because of the presence of the check valve 89, so that the pressure in the line 5*b* and hence in the pilot oil passage 87 rises. As a result, the circulation valve 82 is shifted against the force of the spring 86 to the position where the ports 84 and 85 communicate with each other, whereupon the oil in the rod-side chamber is allowed to flow out. The check valve 88 allows only the flow of oil directed from the port 85 to the port 84. Although the ports 85 and 83 communicate with each other, the port 83 is blocked because of the presence of the check valve 89. Thus, the return oil from the rod-side chamber joins the pressure oil from the pump and flows into the piston-side chamber of the dump cylinder 5, so that the rod of the dump cylinder 5 is advanced at a speed which is increased by an amount corresponding to the amount of the return oil from the rod-side chamber of the dump cylinder 5, forwardly tilting the bucket 3 to provide rapid dumping.

Figure 13:
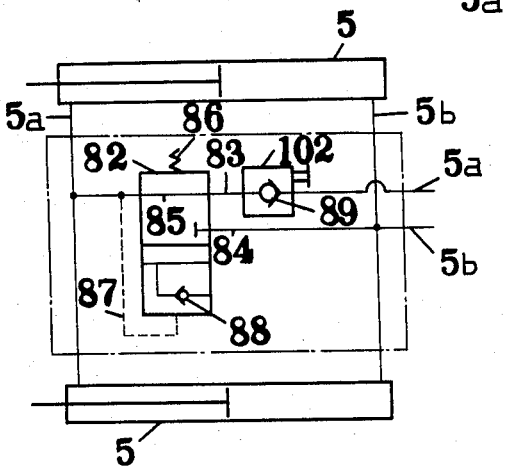

A modification of the speedup device shown in FIG. 13 is arranged to derive the pilot pressure from the return oil side of the pump cylinder 5, i.e., from the oil passage between the circulation valve 82 and the rod-side chamber, in contrast with the embodiment shown in FIG. 13, but the rest of the arrangement and the way the device operates are the same.

Figure 14:
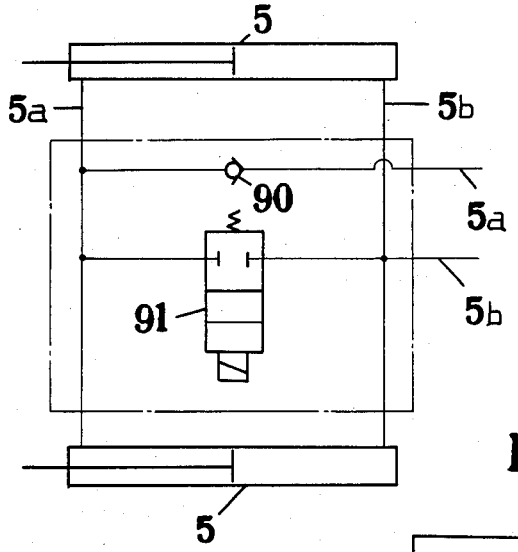

FIG. 14 shows a modification of the speedup device, using a solenoid valve. A check valve 90 which allows only the flow of oil directed to the rod-side chamber is installed in the oil passage which connects the rod-side chamber of the dump cylinder 5 to the directional control valve for the dump cylinder. The piston-side chamber of the dump cylinder 5 is connected to the directional control valve for the dump cylinder through the line 5*b*, and a 2-port 2-position solenoid valve 91 is provided between the line 5*b* and the line 5*a* which is disposed between the check valve 90 and the rod-side chamber. By associating the shifting of the solenoid valve 91 with the shifting of the directional control valve for the dump cylinder, there is obtained the same effect of speeding up the advance of the dump cylinder rod as in the embodiments described above.

Figure 15:
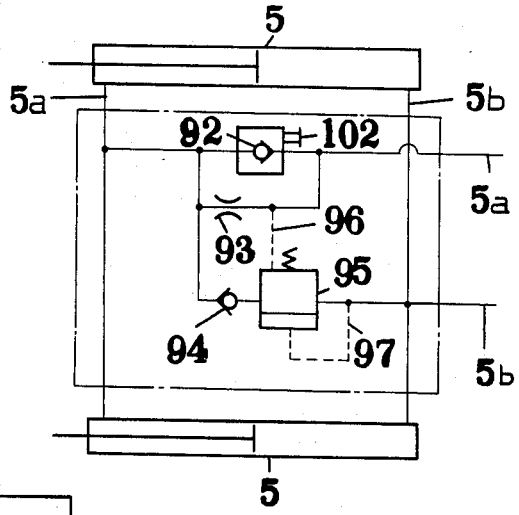

FIG. 15 shows a further modification of the speedup device, wherein a parallel combination of a restrictor 93 and a check valve 92 which allows only the flow of oil directed to the rod-side chamber of the dump cylinder 5 is placed in the line 5*a* which connects the rod-side chamber of the dump cylinder to the directional control valve for the dump cylinder. The piston-side chamber of the dump cylinder 5 is connected to the directional control valve for the dump cylinder 5 through the line 5*b*, and a series combination of a changeover valve 95 and a check valve 94 which allows only the flow of the return oil from the rod-side chamber is connected between the line 5*a* on the cylinder side and the line 5*b* through the check valve 92 and the restrictor 93. The valve 95 is normally held by a spring in a position where it blocks flow, and has opposed pilot oil passages 96 and 97 leading from the line 5*a* between the restrictor 93 and the directional control valve and from the line 5*b* between the valve 95 and the directional control valve.

As for the rod retraction of the dump cylinder 5, i.e., the scooping action of the bucket, it is effected at the normal speed since the speedup device does not function, as in the preceding embodiment. As for the advance of the rod, i.e., the dumping action of the bucket, since the line 5*a* is in constant communication with the tank through the restrictor 93, accelerated dumping is effected only when the amount of the oil being fed from the pump is large, while when it is small, the valve 95 will not open since the pressure in the pilot oil passage 99 does not increase, so that dumping takes place at the non-increased, normal speed.

Figure 16:
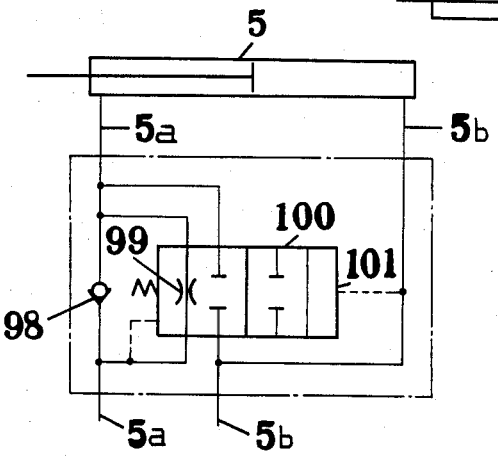

The flow control of the hydraulic pump can be effected by controlling the degree of opening of the engine throttle valve of the tractor. When it is desired to prevent damage to the object to be handled, the hydraulic pump is rotated at low speed to provide a reduced flow rate of pressure oil fed from the pump so as to advance the rod of the dump cylinder 5 at low speed. Reversely, when rapid dumping is desired for increased efficiency of operation, the hydraulic pump is rotated at high speed to increase the rate of flow of pressure oil to the cylinder 5. In this case, a speedup device shown in FIG. 16 functions in the following manner to achieve such accelerated dumping: When the rod is advanced, the oil in the rod-side chamber of the dump cylinder 5 returns to the tank by flowing through a restrictor 99 because of the presence of a check valve 98, but if the rate of supply of pressure oil to the piston-side chamber is increased, the pressure in the line 5*b* rises because of the presence of the restrictor 99, such increased oil pressure being transmitted to a circulation valve 100 through an oil passage 101, thus switching the valve 100. As a result, the return oil from the rod-side chamber of the cylinder 5 does not return to the tank and instead it is all transferred to the piston-side chamber of the cylinder 5, so that the rod of the dump cylinder 5 is advanced at an increased speed, thus rapidly dumping the bucket.

By increasing the rod advancing speed, i.e., the bucket dumping speed by allowing the oil from the rod-side chamber of the dump cylinder 5 to join the oil from the pump and the combined flow to enter the piston-side chamber at the time of advancing the rod of the dump cylinder, i.e., dumping the bucket as described above, the efficiency of operation is increased and the release of adhesive objects to be handled is improved. Moreover, there is no need to increase the size of the hydraulic pump and pipings and it is only necessary to incorporate the speedup device of this invention in the oil passage which connects the rod-side and piston-side chambers of the dump cylinder to the directional control valve for the dump cylinder. Thus, it can be installed on any existing front loader simply and inexpensively and is advantageous.

Particularly in the case of a farm front loader, however, the transport and stowage of relatively easily crushable farm products, such as beets, potatoes and cabbages, must be performed besides the transport of earth and sand, compost and pasture and removal of snow. In the former case, the dumping speed for discharging the scooped object should be the non-increased, normal one since otherwise the farm product would be damaged. Therefore, it is desirable that any suitable value for the rotative speed of the working implement, i.e., the rod advancing speed of the dump cylinder 5 can be selected according to the type of the object to be handled.

Provided to this end is a mechanism 102 shown in FIGS. 12, 13 and 15 which cancels the unidirectionality of the check valves 89 and 92. If the check valves 89 and 92 are forcibly opened by this mechanism, even at the time of advancing the rod of the dump cylinder 5 the speedup valve will not function, this allowing the rod advancing operation of the dump cylinder 5 to be effected at the normal speed. In this way, the oil in the rod-side chamber of the dump cylinder is or is not allowed to join the pressure oil from the pump so as to select a suitable dumping speed according to the type of the object to be handled. The control of such joining of oil flows is not limited to the above described type which cancels the unidirectionality of check valves and it may have any of other various constructions.

A mechanism will now be described which serves to transmit through a single operating lever an input to the pair of hydraulic circuit control systems according to the various embodiments of the invention described so far. Although this mechanism will be described in connection with the embodiment shown in FIG. 2 for the sake of convenience, it is to be understood that the description is applicable also to the other embodiments so far as this mechanism is concerned.

Figure 18:
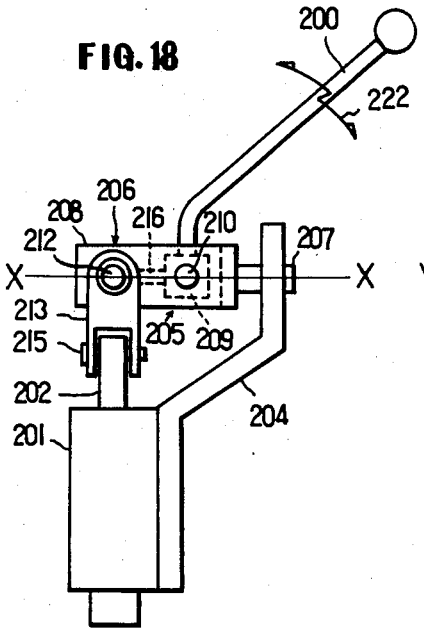
FIGS. 17 through 19 are a front view, a side view and a plan view, respectively, of a control unit in a hydraulic control circuit system according to the present invention.
Figure 17:
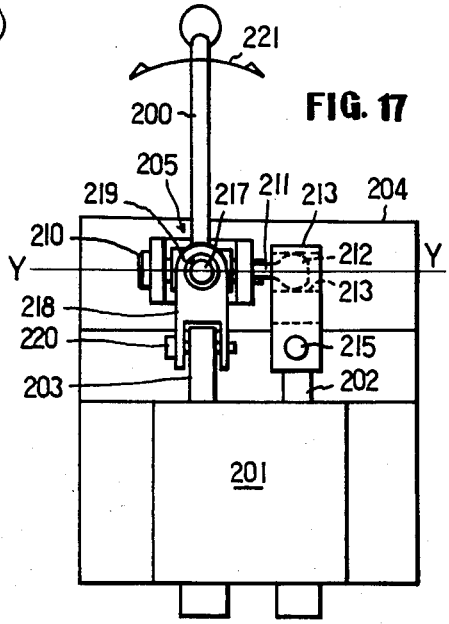
Figure 19:
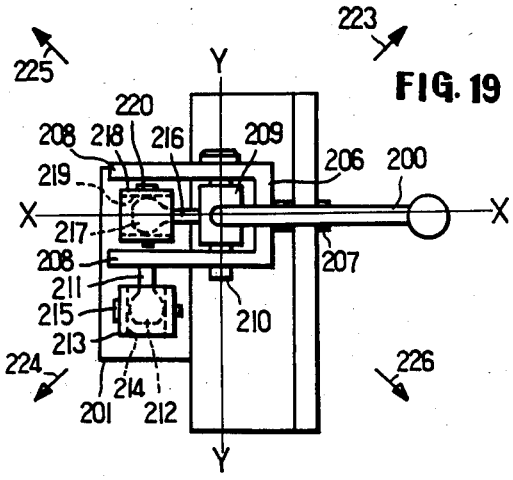

Referring to FIGS. 17 through 19, a control unit comprises a single operating lever 200, a valve box 201 including integrally constructed directional control valves A and B for the lift cylinder and dump cylinder, respectively, and a mechanism to be presently described for transmitting the movement of the operating lever 200 to the directional control valves A and/or B. The directional control valves A and B are of the slide spool type, and only the end portions of their parallelly extending spools 202 and 203 are seen. The single operating lever 200 is attached through a universal joint 205 to a portion of the valve box 201 or to a portion of an attaching base plate 204 by which the control unit is attached to the tractor 1. The universal joint 205 comprises a first pivot shaft member 206 which on one side 207 is inserted in the attaching base plate 204 for rotation around the X—X axis and which on the other side 208 is bifurcated, and a second pivot shaft member 209 pivotally connected to the legs 208 of the first pivot shaft member 206 by a pin 210 so that it can be rotated around the Y—Y axis which is at right angles with the rotary axis X—X of the first pivot shaft member 206. The axis X—X of the first pivot shaft member 206 is at right angles with the axis of the second pivot shaft member 209, as described above, and the end of the operating lever 200 is integrally joined to the second pivot shaft member 209 at the intersection of said axes.

The first pivot shaft member 206 is integrally formed with an actuator 211 projecting from one leg 208 of the first pivot shaft member 206 in the direction of the axis Y—Y of the second pivot shaft member 209, said actuator having a spherical front end 212 which is received in a ball articulated joint fashion in a hole 214 formed in a link 213 which is pivotally connected to the end of the spool 202 of the directional control valve A by a pin 215. Similarly, the second pivot shaft member 209 is integrally formed with an actuator 216 projecting in the direction of the axis X—X of the first pivot shaft member 206, said actuator having a spherical front end 217 which is received in a ball articulation joint fashion in a hole 219 formed in a link 218 which is pivotally connected to the end of the spool 203 of the directional control valve B by a pin 220.

With the arrangement thus made, if the operating lever 200 is tilted to the left or to the right as indicated by arrows in FIG. 17, the first pivot shaft member 206 is turned around the axis X—X to cause the actuator 211 and link 213 to slide the spool 202, thereby switching the directional control valve A. Therefore, the lift cylinder 4 alone operates. If the operating lever 22 is tilted to the front or to the rear as indicated by arrows 222, the second pivot shaft member 209 is turned around the axis Y—Y to cause the actuator 216 and link 218 to slide the spool 203, thereby switching the directional control valve B. Therefore, the dump cylinder 5 alone operates. If the operating lever 200 is positioned at the intersection between the axes X—X and Y—Y as shown, neither of the directional control valves operates.

Further, if the operating lever 200 is tilted in the direction of arrow 223 shown in FIG. 19, both spools 202 and 203 are pulled up, that is, the directional control valves A and B are shifted to the right as viewed in FIG. 2, so that the lifting of the arm 2 and the scooping of the bucket 3 are effected at the same time. Similarly, if the operating lever is tilted in the direction of arrow 224, lowering and dumping are effected; if it is tilted in the direction of arrow 225, lifting and dumping are effected at the same time; and if it is tilted in the direction of arrow 226, lowering and scooping are effected at the same time. Thus, the arm 2 and the bucket 3 are simultaneously operated.

In this way, by manipulating the single operating lever 200, it is possible to attain eight different modes of operation, including not only individual operations of the lift cylinder 4 and dump cylinder 5 but also simultaneous operation of both cylinders, depending upon the position of the operating lever, in a very simple manner. In addition, in order to ensure that these operations will be correctly performed, it is desirable to provide a guide plate which has shift guide grooves for guiding the operating lever 200 and which bears letters, signs or other marks indicating the operative functions corresponding to the respective guide grooves.

The mechanism for transmitting an input produced by the single operating lever to the directional control valves is not limited to the one illustrated and described above. It will be possible for those skilled in the art to modify the same to provide various forms which present the same merits provided that where the hydraulic control circuit system includes circuit means for individually operating a pair of cylinders and circuit means for simultaneously operating said cylinders, said forms are capable of operating directional control valves associated with said cylinders by means of a single operating lever.

What is claimed is:

1. A hydraulic control system for controlling the rod advancing and retracting actions of fist and second double-acting cylinders each having a piston movable therein with its piston-rod extending through an end of the cylinder, said piston dividing the interior of the cylinder into a piston-side chamber and a rod-side chamber, said control system comprising a hydraulic pump for supplying said double-acting cylinders with pressure oil, directional control valves respectively associated with said cylinders for controlling the supply of pressure oil to said cylinders, first circuit means for independently operating said cylinders, and second circuit means for causing the rod advancing and retracting actions of said first cylinder to be operatively associated with the rod advancing and retracting actions of said second cylinder said second circuit means comprising a first oil passage for feeding oil from the rod-side chamber of said first cylinder to the piston-side chamber of said second cylinder when the rod of said first cylinder is being advanced, a second oil passage having a restrictor for returning oil from the rod-side chamber of said second cylinder to a tank during said rod advancing operation, a third oil passage for feeding oil from the piston-side chamber of said first cylinder to the rod-side chamber of said second cylinder when the rod of said first cylinder is being retracted, a fourth oil passage having a restrictor and branching off from said third oil passage and leading to a tank, and a fifth oil passage for returning oil from the piston-side chamber of said second cylinder to the tank, said system including a speedup device which increases the rod advancing speed of said second cylinder by transferring oil from the rod-side chamber of said second cylinder to the piston-side chamber of said second cylinder.

2. A system as set forth in claim 1, wherein said speedup device includes a changeover mechanism whereby the rod-side chamber of said second cylinder can be selectively connected either to the tank or to the piston-side chamber of said second cylinder when the rod of said second cylinder is being advanced.

3. A system as set forth in claim 1, wherein the restrictor in the second oil passage through which the return oil from the rod-side chamber of said second cylinder passes when the rod of said first cylinder is advanced is controlled by a pilot pressure derived from said first oil passage which connects the rod-side chamber of said first cylinder to the piston-side chamber of said second cylinder.

* * * * *